United States Patent [19]

Nomura et al.

[11] 4,023,987

[45] May 17, 1977

[54] METHOD OF PRODUCING SOFT THIN STEEL SHEET BY CONTINUOUS ANNEALING

[75] Inventors: Giichiro Nomura, Kudamatsu; Takuo Ando, Yokohama; Keiji Ariga, Kudamatsu; Akira Ikeda, Kudamatsu; Kinji Saijo, Kudamatsu; Taizo Sato, Kudamatsu, all of Japan

[73] Assignee: Toyo Kohan Co., Ltd., Japan

[22] Filed: Dec. 10, 1975

[21] Appl. No.: 639,608

[30] Foreign Application Priority Data

Dec. 20, 1974 Japan ..... 49-145750

[52] U.S. Cl. ..... 148/12 D; 148/12 F; 148/134; 148/143; 148/36

[51] Int. Cl.[2] ..... C21D 9/48

[58] Field of Search ..... 148/12 C, 12 D, 12 F, 148/12.3, 36, 134, 143

[56] References Cited

UNITED STATES PATENTS

| | | | |
|---|---|---|---|
| 3,806,376 | 4/1974 | Toda et al. | 148/12 C |
| 3,839,095 | 10/1974 | Kubotera et al. | 148/12 C |
| 3,920,487 | 11/1975 | Gondo et al. | 148/12 C |

FOREIGN PATENTS OR APPLICATIONS

| | | | |
|---|---|---|---|
| 2,107,640 | 2/1971 | Germany | 148/12.3 |

*Primary Examiner*—Arthur J. Steiner
*Attorney, Agent, or Firm*—Wenderoth, Lind & Ponack

[57] ABSTRACT

A continuous annealing process for producing a soft tin plate and black plate with T - 2½ or T - 3 tempering properties is attained in a conventional continuous annealing furnace for black plate by the use of a novel steel strip composition.

6 Claims, 6 Drawing Figures

Hardness of Tinplate (HR 30T)
56
55
54
53
52
H
Y
700
750
800
900
Soaking Temperature (°C)

Hardness of Tinplate (HR 30T)
58
57
56
55
H
X
Y
10
30
50
100
Cooling Rate (°C/sec)

METHOD OF PRODUCING SOFT THIN STEEL SHEET BY CONTINUOUS ANNEALING

BRIEF SUMMARY OF THE INVENTION

The present invention relates to a method of producing a soft low carbon thin steel sheet and especially relates to a method of producing soft tin plate and black plate. In particular, the present invention relates to a continuous annealing process to produce a soft tin plate and black plate with T – 2½ or T – 3 tempering properties from a novel steel strip composition. It had previously been considered impossible to fabricate such products by a conventional continuous annealing furnace for black plate, and therefore such products have heretofore been produced by a box annealing process.

BACKGROUND OF THE INVENTION

Figure 1:
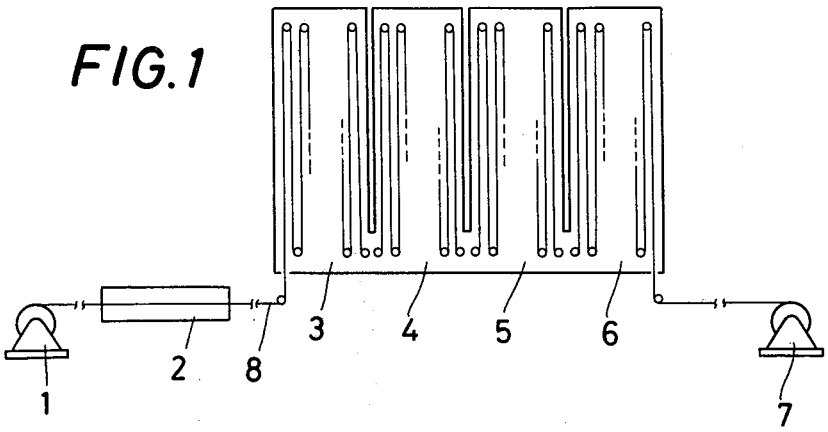
FIG. 1 is a diagram of a conventional continuous annealing line which is commercially used to anneal the steel strip for tin plate and black plate.

There are two type of annealing processes for the annealing of cold rolled low carbon steel strip. One is a continuous annealing process and the other is a box annealing process.

The continuous annealing process was originally developed, and has been used in Japan and other countries mainly to produce the steel strip for tin plate and black plate.

Tin plate and black plate are used for various purposes and their tempering properties are selected according to the demands of various finished articles.

In section 5 of JIS (Japanese Industrial Standard) G 3303-1969 (hereinafter referred to as "JIS") "Tin plate and Black plate", the temper of tin plate and black plate is designated by numerical value of the Rockwell 30T hardness (HR 30T) and it is also remarked that "the term 'temper' when applied to tin plate and black plate can not essentially be represented by any single mechanical property. However, the Rockwell 30T hardness test value is chosen as one of the most effective guide of interrelated mechanical properties".

Furthermore, in A 623-1973 of the ASTM (American Society for Testing and Materials) Standard (hereinafter referred to as "ASTM"), the term "temper" is defined as follows: "7.1 Single-Reduced Tin Mill Product, Temper-the term temper when applied to single-reduced tin mill products summarizes a combination of interrelated mechanical properties. No single mechanical test can measure all the various factors which contribute to the fabrication characteristics of the material.

The Rockwell 30T hardness value has come into general use as a quick test which serves as a guide to the properties of the plate.

The temper of "tin plate and black plate" is designated by a numerical value of the Rockwell 30T hardness and this numerical value serves as a guide to the production of tin plate and black plate. The temper ranges of tin plate and black plate, represented by the Rockwell 30T hardness value, at which the producer should aim, are classified into seven JIS classifications as shown in Table I. The classification of the temper in the ASTM scheme is similar to that of Table I but T - 2½ is not included in the ASTM scheme.

In Table I, temper T - 1 and T - 2 are extremely soft and therefore are utilized where severe forming conditions are to be encountered. Temper T - 4, T - 5, T - 6, T - 4 - CA, T - 5 - CA, T - 6 - CA are utilized when stiffness and hardness of tin plate or black plate is especially required.

Tin plate with temper T - 2½ and T - 3 properties are most suitable for normal can body and end use as well as for various other purposes. Therefore the demand for T - 2½ and T - 3 material is the greatest.

TABLE I

The temper of tin plate under JIS standards

| Box annealing process | | Continuous annealing process | |
|---|---|---|---|
| Temper designation | Aim HR 30 T | Temper designation | Aim HR 30T |
| T - 1 | 49±3 | | |
| T - 2 | 53±3 | | |
| T - 2½ | 55±3 | | |
| T - 3 | 57±3 | | |
| T - 4 | 61±3 | T - 4 - CA | 61±3 |
| T - 5 | 65±3 | T - 5 - CA | 65±3 |
| T - 6 | 70±3 | T - 6 - CA | 70±3 |

However, tin plate or black plate with temper T - 2½ or T - 3 properties has not yet been produced by a conventional continuous annealing process, and therefore has been produced by a box annealing process as can be seen from Table I.

The steel strip for black plate is cold rolled to a more than 80% reduction in thickness so that the steel strip after cold rolling is very hard, low in ductility and shows a fiber structure. Therefore it is necessary to anneal the cold rolled strip to recrystallize, cause grain growth, change the fiber structure into the granular structure, and give softness and workability to the steel strip.

In a box annealing process, coils of the steel strip are piled on one or several stacks within an inner cover filled with a slightly reducing gas atmosphere. The stack of coils in the inner cover is heated by a Bell-type heating furnace covering the inner cover and it takes several days to finish the box annealing heat cycle, i.e. the heating process, the soaking process and the cooling process.

The deformation of the steel strip and furthermore, annealing stickers sometimes occur during box annealing. These defects lead to the inferior shape of the steel strip and also to the low yield of the product.

Furthermore, box annealing products show a considerable heterogeneity in their mechanical properties because of the localized heat application and the non-uniformity of heat distribution within a coil and between coils. However, the long heating and soaking time in the box annealing cycle lead to an appropriately large grain size, and the long cooling time leads to a nearly complete precipitation of carbon and nitrogen from the ferrite matrix which had been dissolved in said matrix at the soaking temperature. Consequently the box annealed products are soft and have excellent formability as well as a quite low aging tendency due to its low carbon and nitrogen content in solution.

On the other hand, as shown in FIG. 1, the continuous annealing furnace for tin plate is divided into four main zones; heating zone 3, soaking zone 4, slow cooling zone 5 and fast cooling zone 6. A certain number of upper rolls and bottom rolls are provided in each zone. The cold rolled steel strip 8 is fed from the pay-off reel 1, cleaned in the cleaning section 2 in order to remove rolling lubricants and then runs through upper and bottom rolls in strands as shown in FIG. 1. Then the steel strip is recoiled by the recoiler 7 at room temperature after the whole cycle of heating, soaking, slow cooling and fast cooling. This whole process takes only a few minutes.

Throughout this annealing process the strip is protected from oxidation by a protective gas atmosphere. The products continuously annealed show uniform mechanical properties because of the uniformity of heat distribution in the steel strip. Furthermore the tension in the furnace section results in a product of superior shape, and the products can be produced in a short time by continuous annealing. However, grain growth in the course of recrystallization is not sufficient because of very short heating time and soaking time. Moreover, carbide and nitride do not precipitate sufficiently, almost all of these two elements, dissolved in ferrite matrix during the soaking period, remain in a supersaturated solid solution after annealing because of an extremely short cooling time compared with that of box annealing. Consequently continuously annealed steel strip is sufficient in strength but is slightly lacking in workability and inevitably shows aging phenomena because of the two above-mentioned causes.

Type MR steel and Type MC steel are known as representative raw materials for tin plate and black plate in JIS. Cast chemical compositions of Type MR and MC steels are shown in Table II.

TABLE II

Chemical composition of base metal steel

| Base-metal Steel type | Cast chemical composition, max., % C | Si | Mn | P | S | Cu |
|---|---|---|---|---|---|---|
| MR | 0.13 | 0.01 | 0.60 | 0.020 | 0.050 | 0.20 |
| MC | 0.13 | 0.01 | 0.70 | 0.150 | 0.050 | 0.20 |

Type MR steel is a normal low carbon steel, and Type MC steel is a low carbon steel rephosphorized in order to increase its strength. In a box annealing process, black plate with temper T - 1, T - 2, T - 2½ or T - 3 is usually produced from Type MR material.

On the other hand, black plate with temper T - 4, T - 5 or T - 6 is usually produced from Type MC steel or Type MR steel renitrogenized with 0.007% nitrogen minimum. A continuous annealing process is suitable for the production of black plate having good stiffness together with high strength. In a continuous annealing process, type MC steel or Type MR steel renitrogenized with 0.007% nitrogen minimum is used to produce the black plate with temper T - 6 - CA or T - 5 - CA, and Type MR steel is used to produce the black plate with temper T - 5 - CA or T - 4 - CA. However, it has not yet been possible to produce black plate with temper T - 2½ or T - 3 by a conventional continuous annealing process.

Recently new techniques have been developed to apply the continuous annealing process to the production of normal cold rolled steel sheet for thicker gauges than tin plate.

In these new developments, the steel strip is so constituted as to be given a special treatment, i.e. holding at some intermediate temperature after or in the course of cooling from the recrystallization temperature, to promote the precipitation of carbon which was dissolved into the iron matrix at the recrystallization temperature for the promotion of softening of the iron matrix. This treatment for the promotion of softening by the precipitation of carbides is referred to as "overaging treatment" or "shelf-treatment".

For instance, in laid-open Japanese patent application No. Sho 49-35218, a method is described to produce the low carbon steel strip having low yield strength, high Lankford's *r* value, and good conical cup value by a continuous annealing process.

The raw materials suitable for this purpose should contain low manganese ( $\leqq$ 0.30), low nitrogen ( $\leqq$ 20 ppm) and also satisfy the following formula:

$$O \leqq (Mn\%) - \frac{\text{atomic weight of Mn}}{\text{atomic weight of O}} \times (O\%) - \frac{\text{atomic weight of Mn}}{\text{atomic weight of S}} \times (S\%) \leqq 0.15.$$

Then the hot steel strip is coiled at high temperature i.e. 600° – 800° C after hot-strip rolling, heated and soaked to produce recrystallization and then undergoes the overaging treatment in a continuous annealing line after cold-rolling. German Offenlegungsschrift 2064487 has the same claims as the laid-open Japanese patent application No. Sho 49-35218 but has a restriction of Mn = 0.25% and no restriction of nitrogen.

In the second example thereof, Japanese patent publication No. Sho 49-1968 is described as follows: the cold rolled low carbon steel strip is rapidly cooled to below 200° C with a cooling rate of more than 20° C/sec when the soaking temperature is lower than the $A_1$ point. When the soaking temperature is higher than the $A_1$ point, the cold rolled low carbon steel strip is slow cooled to just below the $A_1$ point with the cooling rate of less than 20° C/sec and then rapidly cooled to below 200° C with a cooling rate of more than 20° C/sec. After rapid cooling, the cold rolled low carbon steel strip is re-heated to an overaging temperature and kept at this temperature for a few minutes, (3 – 5 minutes in the examples). A low carbon steel strip having low yield strength and excellent elongation is obtained by this method.

As a third example, in laid-open Japanese patent application No. Sho 47-26313, a carbon steel ingot (0.02% $\leqq$ C $\leqq$ 0.10%) is rolled to form a slab, is hot-strip rolled and is coiled at normal temperature or at a higher temperature (above 630° C), and then is cold rolled. The cold rolled low carbon steel strip is heated to a temperature between the recrystallization temperature and 850° C in the continuous annealing furnace, and then is slowly cooled to a temperature ranging between 600° C and near the $A_1$ point, and then is rapidly cooled to room temperature with the cooling rate of 200° C/sec – 10,000° C/sec. The steel strip rapidly cooled to room temperature is re-heated to a temperature between 300° C and 530° C and is kept for more than 10 seconds at this temperature. The low carbon steel sheet having excellent drawability and low aging properties can be efficiently produced by this continuous annealing process and its properties in drawability and aging is described to be equal to or better than that of the box annealed product.

The newly developed special continuous annealing methods mentioned above enables the fabrication of a soft steel strip with excellent workability by continuous annealing. However, these methods will be expensive because it is necessary to observe several restrictions including overaging treatment. Moreover, the continuous annealing equipment becomes complicated and the length of the total line becomes very long compared with the length of the conventional continuous annealing line for tin plate and black plate.

The several restrictions mentioned above are as follows:

1. A severe limitation concerning the composition of the steel is necessary.
2. Hot-coiling at considerably higher temperature after hot-strip rolling is required.
3. "Overaging treatment" is necessary.
4. Overaging time is long.
5. Rapid cooling prior to the overaging treatment is necessary.

Furthermore, the steel strip for tin plate and black plate is very thin, and therefore the reduction in cold rolling is more than 80% even when thin hot-rolled steel strip (2.0 mm thick) is used. Consequently, the steel strip for tin plate or black plate is somewhat inferior in workability after annealing to a normal cold rolled steel sheet which is cold rolled with a 60 – 70% reduction.

After annealing, black plate is temper rolled and electroplated in the electrolytic tinning line followed by subsequent heating to above 232° C in the "flow brightening" process. Also in the case of hot-dip tinning, black plate is dipped into the molten tin where the temperature is more than 300° C. In other words, after annealing, the steel strip is strained and then heated during the fabrication process of tin plate. Therefore the tin plate products are strain-aged and hardened, and consequently its workability is inferior to the "as annealed state".

Thus, it is difficult to produce an extremely softtin plate having temper T - 1 or T - 2 properties even by the newly developed continuous annealing process for thicker steel sheet mentioned above with the conventional low carbon steel strip.

According to the Journal of the Iron and Steel Institute of Japan, Volume 60 (1974) No. 4, S,331, the coldrolled Type MR steel strip for tin plate (0.32 mm thick), reduced with the reduction of more than 80% was annealed under continuous conditions disclosed in laid-open Japanese patent application No. Sho 47-26313, temper rolled with an elongation of 1.5%, and then artifically aged by a heat cycle similar to "flow-brightening" in the electrolytic tinning process. A product having temper T - 2½ was consequently obtained.

Therefore it became clear that these new continuous annealing processes for the thicker cold rolled steel strip utilizing overaging treatment made it only possible to fabricate tin plate as soft as temper T - 2½ at best.

DETAILED DESCRIPTION OF THE INVENTION

With the process of the present invention, it is possible to produce soft tin plate and black plate having temper T - 3 or T - 2½ with a slight but feasible restriction concerning the composition of type MR steel (JIS). Type MR steel is widely used as the most suitable raw material for tin plate and black plate.

The continuous annealing cycle used includes a conventional continuous annealing cycle for tin plate stock, hereinafter referred to as the first embodiment or a slightly modified continuous annealing cycle utilizing a short overaging treatment, hereinafter referred to as the second embodiment.

In the present invention, coiling at high temperature after hot-strip rolling is not necessarily required and a very long furnace for overaging is unnecessary because a short overaging treatment provides sufficient softening, and it is possible to use a conventional continuous annealing line for tin plate and black plate without any remodeling. Therefore the present invention is very useful for continuously annealing the steel strip for tin plate and black plate.

Figure 2:
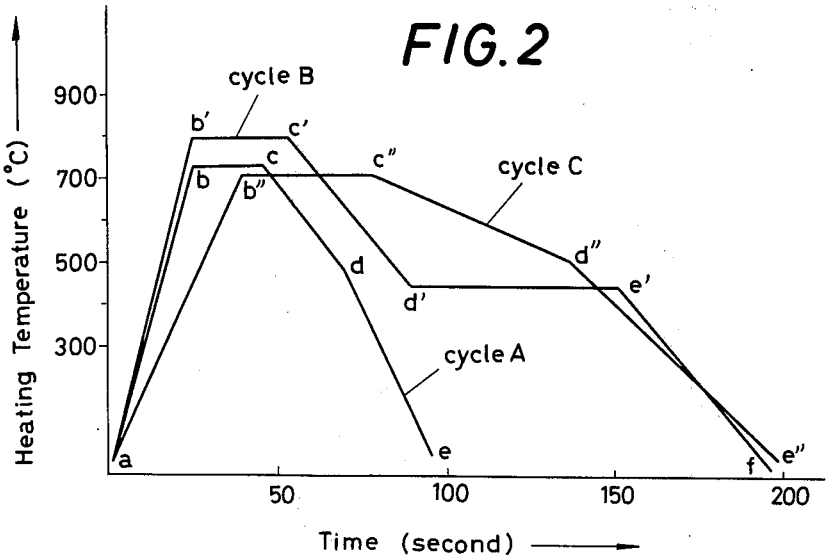
FIG. 2 shows three examples of schematic diagrams for continuous annealing heat cycle for tin plate and black plate.

In the following, we explain the present invention in detail. Three typical examples of continuous annealing cycle are shown in FIG. 2. The normal continuous annealing furnace for tin plate is divided into four main zones; a heating zone, a soaking zone, a slow cooling zone and a fast cooling zone as shown in FIG. 1.

The total length of the steel strip stored in each zone is calculated from three factors; the diameters of the top and bottom rolls, the distance from the top rolls to the bottom rolls and the number of passes (number of strands).

A practical annealing cycle in a specific continuous annealing line is determined by the temperature in each zone, the operating speed and the length of the cold rolled steel strip stored in each zone.

The ratio of seconds, in which the steel strip passes through the above said four zones, is constant and independent of the operating speed of the continuous annealing line.

The cycle A in FIG. 2 shows an annealing cycle in a conventional industrial continuous annealing line utilized for tin plate and black plate (this line is hereinafter referred to as No. 1 CAL) with the following conditions, soaking temperature: 730° C, operating speed: 366 m/min (1200 fpm). This No. 1 CAL has a heating zone with 10 passes, a soaking zone with 8 passes, a slow cooling zone with 10 passes and a fast cooling zone with 10 passes.

In the operation shown as the cycle A in FIG. 2, the steel strip is heated from room temperature (point a in FIG. 2) to 730° C in 25 seconds during its passage through the heating zone (point b in FIG. 2), is soaked at this temperature for 20 seconds (point c in FIG. 2), slow cooled to 480° C in 25 seconds (point d in FIG. 2), at the cooling rate of 10° C/sec and is then fast cooled to room temperature in 25 seconds (point e in FIG. 2). In this cycle, it takes about 20 seconds to cool from 550° to 250° C, and the total annealing time is 95 seconds.

This No. 1 CAL is operated commercially within the speed range of from 458 m/min (1500 fpm) to 305 m/min (1000 fpm), and the corresponding cooling time from 550° to 250° C is from 16 seconds to 24 seconds respectively, and the total time for annealing is from 76 seconds to 114 seconds respectively.

A normal continuous annealing cycle for black plate falling within the scope of the first embodiment of this invention, has the following characteristics; (1) the total time is within 2 minutes and (2) the time needed to cool from 550° to 250° C is within 30 seconds. The cycle A shown in FIG. 2 is a typical example of this category.

The cycle C in FIG. 2 shows an annealing cycle in another industrial continuous annealing line for tin plate and black plate (this line is hereinafter referred to as No. 2 CAL) with the following conditions, soaking temperature: 707°– 715° C, operating speed: 183 m/min (600 fpm). This line has a heating zone with 8 passes, a soaking zone with 8 passes, a slow cooling zone with 12 passes and a fast cooling zone with 12 passes. In the operating condition of the cycle C shown in FIG. 2, the steel strip is heated from room temperature (point a in FIG. 2) to 707° C (point *b''* in FIG. 2) in 38.8 seconds during its passage through the heating zone, is soaked or slow heated to 715° C (point *c''* in FIG. 2) for 38.8 seconds, is slow cooled to 507° C (point *d''* in FIG. 2) in 58.4 seconds and then is fast cooled to room temperature in 58.8 seconds (point *e''* in FIG. 2). In this cycle, it takes about 44 seconds to cool from 550° to 250° C, and the total annealing time is 194.8 seconds. If this No. 2 CAL is operated at the speed of 244 m/min (800 fpm), it will take about 33 seconds to cool from 550° to 250° C, with the total annealing time of 146.1 seconds.

It became clear from above examples that the annealing cycle in which the cooling time from 550° to 250° C requires over 30 seconds and can be obtained by reducing the operating speed of the normal continuous annealing line for tin plate and black plate. The cycle C in FIG. 2 is representative The cycle B shown in FIG. 2 is another example, falling within the scope of what will be referred to as the second embodiment of this invention. This cycle B is obtained in a model testing apparatus for continuous annealing operation. In this modeling testing apparatus, it is also possible to obtain cycle A or cycle C shown in FIG. 2 by changing components in the line and the testing speed.

In the operating conditions for cycle B, the steel strip is heated from room temperature (point a in FIG. 2) to 800° C (point *b'* in FIG. 2) in 26 seconds, is soaked at this temperature for 26 seconds (point *c'* in FIG. 2), is cooled to 450° C in 35 seconds at the cooling rate of 10° C/sec (point *d'* in FIG. 2), is overaged at 450° C for 60 seconds (point *e'* in FIG. 2) and then is cooled to room temperature in 45 seconds (point *f* in FIG. 2).

In cycle B, it takes about 91 seconds to cool from 550° to 250° C and the total annealing time is 192 seconds.

To practice this overaging in a commercial continuous annealing line, it is necessary to change the design and alignment of zones in the annealing line, i.e. to introduce an overaging zone between the slow cooling zone and final fast cooling zone. It takes only 30 – 60 seconds, however, to achieve effective overaging in the present invention, therefore it is unnecessary to install a long overaging zone in the line. This superiority leads to the reduction of both the construction cost and the operating cost. The cycle B shown in FIG. 2 is the representative annealing cycle that satisfies the objectives of the second embodiment of this invention, including a comparatively short overaging treatment.

In the following, the cold rolled steel strip of various compositional ranges was annealed by the cycle A, cycle B, cycle C and other similar cycles within the invention. The tests were made by using both the model testing apparatus and the industrial continuous annealing lines for tin plate and black plate. The steel strip after annealing was temper rolled by 1.5%, electrolytically tinned in an acid sulphate bath and then flow-brightened (heated to above the melting point of tin) to bring the steel strip to a fully aged state. Sample discs are cut from the steel strips, and their Rockwell 30T hardness was tested using the Rockwell T superficial hardness tester.

Figure 3:
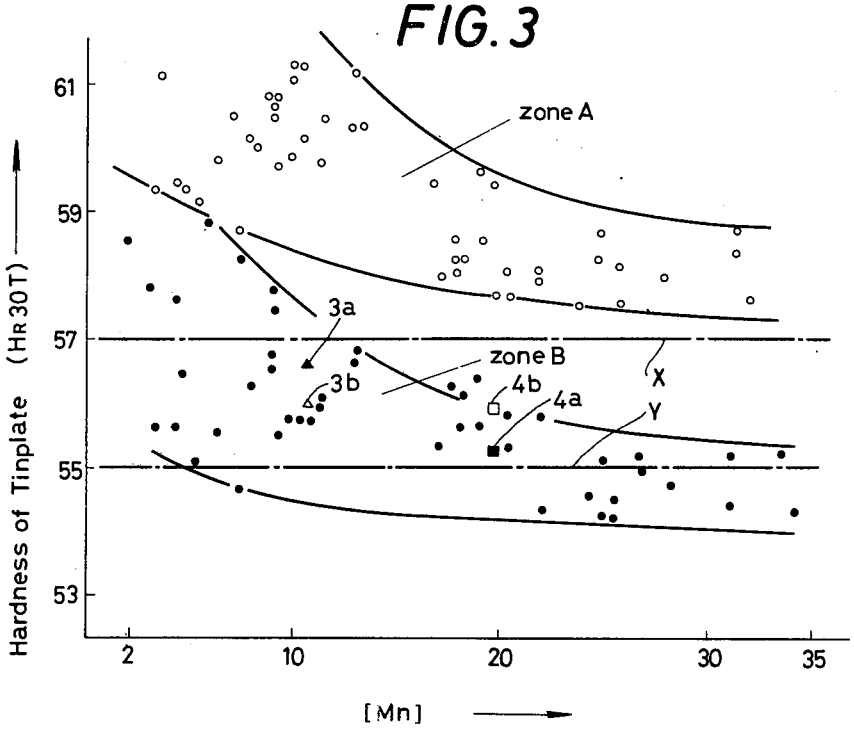
FIG. 3 is a diagram showing the relation between [Mn]/S in steel strips and the Rockwell 30T hardness of tin plate products.

FIG. 3 shows the relation between the Rockwell 30T hardness (Rockwell T superficial hardness: HR 30T) of tin plate products and the value of {(Mn%) – (55/16) (0%) } /(S%) (this formula is hereinafter referred to as [Mn]/S) calculated from the compositions of the steel strip of a low carbon rimmed or capped steel strip.

Zone A in FIG. 3 depicts the Rockwell 30T hardness of the tin plate manufactured by cycle A (in FIG. 2) wherein its carbon content $\leqq$ 0.05%, manganese content $\leqq$ 0.50%, nitrogen content $\leqq$ 0.0030% and phosphorus content $\leqq$ 0.012%. Zone B in FIG. 3 depicts the Rockwell 30T hardness of the tin plate manufactured by cycle B (in FIG. 2) with its carbon content $\leqq$ 0.10% manganese content $\leqq$ 0.50%, phosphorus content $\leqq$ 0.020% and nitrogen content $\leqq$ 0.0030%. In the relationship $$[Mn]/S = \{(Mn\%) - (55/16)\ (0\%)\}/(S\%),$$

(Mn%), (0%) and (S%) are weight percent of manganese, oxygen and sulphur contained in the steel strip respectively, and [Mn] is the quantity of manganese in the steel strip that is able to combine with sulfur to form manganese sulfide. The broken line X, Y corresponds to the center values of temper T - 3 and T - 2½, respectively.

As shown in FIG. 3, a clear correlation between the Rockwell 30T hardness of tin plate and the value of [Mn]/S can be recognized in both zone A and zone B. With an increase in the value of [Mn]/S, the Rockwell 30T hardness is reduced. In the range where [Mn]/S $\geqq$ 20 in zone A, the upper limits of distributed results satisfy the temper T - 3 grade, and so it becomes possible to produce soft tin plate having temper T - 3 properties from this material. In the range where [Mn]/S < 12 in zone B, the Rockwell 30T hardness is rather high and its distribution is considerably scattered. Therefore it is necessary to establish the restriction "[Mn]/S $\geqq$ 12" in order to insure the tin plate products possess temper T - 2½ or T - 3 properties, taking the segregation of the compositions in the steel strip into account.

Comparing zone A with zone B, zone B is found to be 2 or 3 points softer in the Rockwell 30T hardness than zone A, because of the effect of overaging treatment. Therefore the restriction of [Mn]/S in zone B is less than the one in zone A. Points 3*a* and 3*b* in FIG. 3 depict the Rockwell 30T hardness of tine plate with 0.009% vanadium in the cycle A of FIG. 2 and in the cycle B of FIG. 2 respectively. Points 4*a* and 4*b* in FIG. 3 depict the Rockwell 30T hardness of tin plate with 0.19% chromium in the cycle A of FIG. 2 and in the cycle B of FIG. 2 respectively. From these results it is clear that a small amount of carbide forming element in the steel is sufficiently effective in case of the cycle A of FIG. 2, where the Rockwell 30T hardness is 2 – 3 points softer compared with normal steel without special elements and shows the same superior softening effect as in case of the cycle B of FIG. 2.

From the viewpoint of softening steel strips, the higher soaking temperature is favorable, but the upper limit of soaking temperature is restricted to 900° C in consideration of the type of furnace and convenience in operation. As shown in this example, a whole range of temper T - 2½ properties can be realized when proper heat cycles are selected within the scope of the second embodiment of this invention.

Table III

| | Chemical composition of the steel (%) | | | | | | | |
|---|---|---|---|---|---|---|---|---|
| type of steel | C | Si | Mn | P | S | O | N | [Mn]/S |
| rimmed | 0.048 | 0.01 | 0.40 | 0.013 | 0.019 | 0.021 | 0.0025 | 17 |

Figure 4:
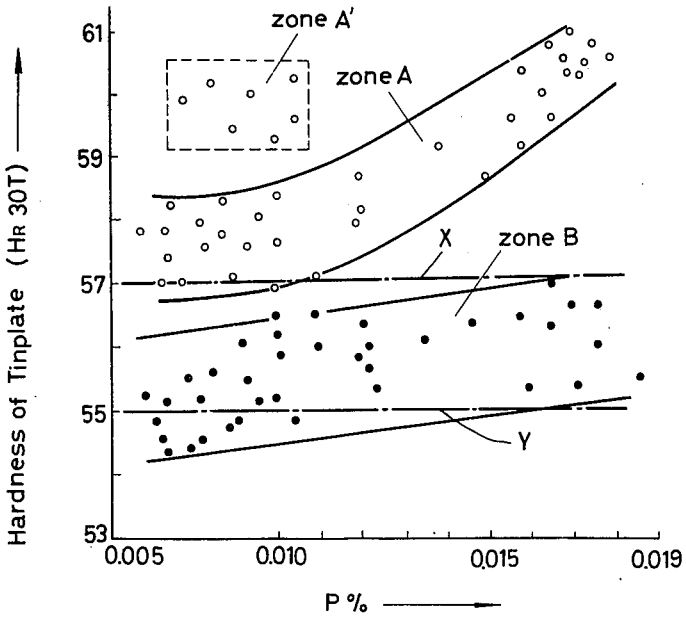
FIG. 4 is the diagram showing the relation between phosphorus content of steel strip and Rockwell 30T hardness of tin plate products.

In FIG. 4 the relation between the phosphorus content and the Rockwell 30T hardness of tin plate is shown. Zone A is the Rockwell 30T hardness of tin plate produced by the cycle A of FIG. 2 with carbon content $\leqq$ 0.05%, manganese content $\leqq$ 0.50%, the value of [Mn]/S $\geqq$ 20 and nitrogen content $\leqq$ 0.0030%. Zone B is the Rockwell 30T hardness of tinplate produced by the cycle B of FIG. 2 with carbon content $\leqq$ 0.10%, manganese content $\leqq$ 0.50%, sulphur content $\leqq$ 0.025%, nitrogen content 0.0030% and the value of [Mn]/S $\geqq$ 12. The broken line X, Y corresponds to the center values of temper T - 3 T - 2½ , respectively. As shown in FIG. 4, a clear relation between the Rockwell 30T hardness of tin plate and its phosphorus content can be recognized. With the decrease in the phosphorus contents, the Rockwell 30T hardness decreases in both zone A and zone B. Particularly in zone A, the Rockwell 30T hardness is remarkably reduced with the decrease in the phosphorus contents.

Zone A′ also depicts the results of tin plate annealed by the cycle A of FIG. 2 but resultant hardness is much higher than the ones in zone A, because of higher carbon content (>0.05%). Nevertheless, phosphorus contents are lower than 0.012%. Therefore it is necessary to restrict the range of steel composition to [Mn]/S $\geqq$ 20, P $\leqq$ 0.012% and C $\leqq$ 0.05% in order to stably fabricate the soft tin plate having temper T - 3 properties by means of the cycle A of FIG. 2.

When annealing by the cycle B in FIG. 2 is utilized, if the steel analysis satisfies the restriction [Mn]/S $\geqq$ 20, all results fit in temper T - 3 or T - 2½ range without regard to the phosphorus content, as shown in FIG. 4. Therefore the steel analysis is only required to conform to the restriction on phosphorus content of Type MR steel in JIS, i.e., P $\leqq$ 0.020%.

Figure 5:
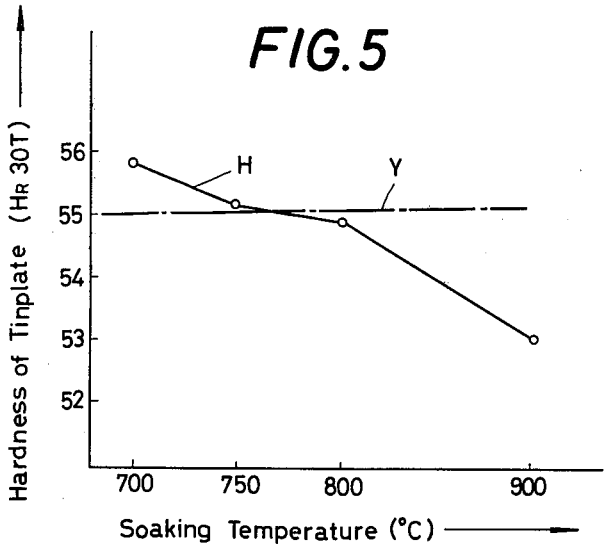
FIG. 5 is a diagram showing the relation between soaking temperature and the Rockwell 30T hardness of tin plate products in heat cycle with overaging.

In FIG. 5 the Rockwell 30T hardness of tin plate was plotted against the change of the soaking temperature in the cycle B of FIG. 2 which is representative of a similar cycle and its composition as shown in Table III. The broken line Y is corresponding to the center value of temper T - 2½.

The curve H shows that the Rockwell 30T hardness decreases with increasing soaking temperature. This softening with increasing temperature is due to sufficient grain growth.

Figure 6:
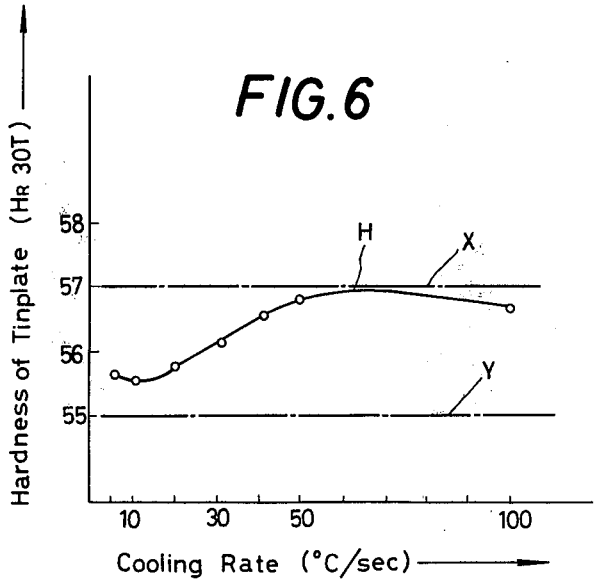
FIG. 6 is a diagram showing the relation between the cooling rate before arriving at the overaging temperature and the Rockwell 30T hardness of tin plate products.

In FIG. 6, the Rockwell 30T hardness of tin plate is plotted against the cooling rate from the soaking temperature (800° C) to the temperature of overaging treatment (450° C × 60 sec.) similar to the one in cycle B of FIG. 2. The broken lines X and Y correspond to the center value of temper T - 3 and T - 2½, respectively. The composition of the steel strip used is shown in Table IV. The range of variable cooling rate lies between 5° C/sec and 100° C/sec in FIG. 6.

TABLE IV

| | Chemical composition of the steel (%) | | | | | | | |
|---|---|---|---|---|---|---|---|---|
| Type of steel | C | Si | Mn | P | S | O | N | [Mn]/S |
| rimmed | 0.054 | 0.01 | 0.33 | 0.007 | 0.010 | 0.013 | 0.0025 | 29 |

The curve H in FIG. 6 shows that the Rockwell 30T hardness of tin plate is minimized when the cooling rate is under 20° C/sec.

From the viewpoint of practical operation, the cooling rate of less than 20° C/sec is normally employed in the conventional continuous annealing line for tin plate. As an example, the cooling rate from 730° to 480° C in the cycle A is 10° C/sec as shown in FIG. 2. On the other hand, in order to obtain the cooling rate of more than 20° C/sec, it becomes necessary to exceedingly increase the cooling capacity of the slow cooling zone, and yet the softening is small or negligible in the case of the higher cooling rate.

Therefore, a cooling rate of less than 20° C/sec is most desirable from the viewpiont of mechanical properties of tin mill products, simplicity of apparatus and improvement of productivity.

From the explanation hitherto described, it can be concluded that the value of [Mn]/S and phosphorus contents of steel strip, soaking temperature and cooling rate from soaking temperature to overaging temperature have a clear relation to the Rockwell 30T hardness of tin plate and black plate. Also the Rockwell 30T hardness is reduced with lower carbon content of the steel strip.

The following is an explanation of the reasons for restricting the composition of the steel strip in the present invention.

In case of the first embodiment, when the carbon content in the steel strip is more than 0.05%, the Rockwell 30T hardness of the products rises as shown in zone A′ of FIG. 4. Hence the carbon content is restricted to be not higher than 0.05%.

Lower sulphur content is also desirable because the sulphur segregates remarkably in the steel ingot and retards the recrystallization in the annealing of cold rolled strip. However, we set the upper limit of the sulphur content in the first embodiment at $\leqq$ 0.025%, considering the balance of steel quality and the cost needed to remove sulphur from molten steel with some suitable means.

Lower nitrogen content is preferred too, but we restrict the nitrogen content in the first embodiment to $\leqq$ 0.0030% considering the use of normal low carbon MR steel strip. The manganese content in the steel strip is restricted to $\leqq$ 0.50% in the first embodiment by the same reason. The oxygen content in the steel strip reduces the value of the expression (Mn%)−(55/16) × (0%), and deteriorates the value of [Mn]/S consequently; therefore it is desirable to reduce the oxygen content as low as possible. In the case of the second embodiment, it is impossible to fabricate soft tin plate, since the Rockwell 30T hardness of tin plate products increases when the carbon content is more than 0.10%.

With regard to the sulphur, manganese and nitrogen content, we restrict these as follows in the second embodiment for the same reasons as in the first embodiment.

$$S \leqq 0.025\%,\ Mn \leqq 0.50\% \text{ and } N \leqq 0.0030\%.$$

Concerning the oxygen content in the second embodiment, it is desirable to lower it so as not to deteriorate the value of the expression (Mn%)−(55/16) × (0%).

As for the phosphorus content, the Rockwell 30T hardness of tin plate is reduced sufficiently by the restriction of P 0.015% even if the value of [Mn]/S is smaller than 12 as shown in the following example 1 (refer to sample No. 12, No. 13 and No. 14 in Table V and Table VI).

Therefore, it is only necessary to employ normal type MR steel (JIS) with the additional restriction of either [Mn]/S $\geqq$ 12 or P $\leqq$ 0.015% in case of the second embodiment.

Some tin plate samples in FIG. 3 or FIG. 4 also fluctuate to have a temper T - 2½ or T - 3 grade, despite being slightly outside the scope of this invention. But in order to insure the tin plate products possess temper T - 2½ or T - 3 properties, taking the segregation of the compositions in the steel strip into account, the restrictions for the compositions of the steel strip must be as mentioned above.

Concerning the steel types, rimmed or capped steel produced by the top-blown oxygen converter process is desirable. In the fabrication of capped steel ingot, it is desirable to minimize the oxygen content contained in the steel.

Open-hearth steel is not preferred because it is impossible to remove the impurities originating from the scrap and also, open-hearth steel has a higher nitrogen content, resulting in the Rockwell 30T hardness of tin plate produced by open-hearth steel being much higher.

However, steel fabricated by any other processes can be used, if similar to the clean steel produced by the top-blown oxygen process.

The following Examples are representative but not limitative of the present invention.

EXAMPLE 1

Rimmed or capped steel was rolled from an ingot into a slab, hot rolled into hot band of 2 mm thickness, cold rolled after pickling to 0.32 mm (cold reduction 84%), and continuously annealed by the cycle A or the cycle B shown in FIG. 2, temper rolled at a 1.5% elongation, electrolytically tinned, and then, the surface tin was flow-brightened. The compositions of the steel strip employed are shown in Table V. Both the Rockwell 30T hardness after annealing and the Rockwell 30T hardness of tin plate product are shown in Table VI.

The analyses of sample Nos. 1 to 8 satisfy both first and second embodiments, showing temper T - 3 properties via cycle A of FIG. 2 and temper T - 2½ properties via cycle B of FIG. 2.

Sample Nos. 9 and 10, the analyses of which satisfy neither first nor second embodiment, show temper T - 4 or the upper value of T - 3 properties via cycle B of FIG. 2.

Sample Nos. 11 to 14, which satisfy the steel composition of the second embodiment, show temper T - 4 properties via cycle A of FIG. 2, but temper T - 2½ or T - 3 properties via cycle B of FIG. 2.

TABLE V

| | | Chemical composition of the steel ( % ) | | | | | | | | | |
|---|---|---|---|---|---|---|---|---|---|---|---|
| sample No. | steel type | C | Si | Mn | P | S | O | N | [Mn]/S | Cr | V |
| 1 | rimmed | 0.027 | 0.01 | 0.33 | 0.008 | 0.011 | 0.018 | 0.0014 | 24 | | |
| 2 | rimmed | 0.043 | 0.01 | 0.37 | 0.006 | 0.016 | 0.012 | 0.0022 | 21 | | |
| 3 | rimmed | 0.048 | 0.01 | 0.40 | 0.012 | 0.015 | 0.021 | 0.0025 | 22 | | |
| 4 | rimmed | 0.050 | 0.01 | 0.41 | 0.008 | 0.010 | 0.020 | 0.0025 | 34 | | |
| 5 | rimmed | 0.036 | 0.01 | 0.37 | 0.010 | 0.012 | 0.016 | 0.0023 | 26 | | |
| 6 | rimmed | 0.042 | 0.01 | 0.38 | 0.007 | 0.011 | 0.029 | 0.0025 | 25 | | |
| 7 | rimmed | 0.034 | 0.01 | 0.35 | 0.009 | 0.010 | 0.024 | 0.0024 | 27 | | |
| 8 | rimmed | 0.035 | 0.01 | 0.33 | 0.010 | 0.012 | 0.018 | 0.0010 | 22 | | |
| 9 | capped | 0.050 | 0.01 | 0.34 | 0.016 | 0.020 | 0.065 | 0.0024 | 6 | | |
| 10 | rimmed | 0.069 | 0.01 | 0.36 | 0.016 | 0.026 | 0.027 | 0.0039 | 10 | | |
| 11 | rimmed | 0.041 | 0.01 | 0.34 | 0.015 | 0.021 | 0.027 | 0.0028 | 12 | | |
| 12 | capped | 0.036 | 0.01 | 0.29 | 0.013 | 0.030 | 0.054 | 0.0017 | 3 | | |
| 13 | rimmed | 0.051 | 0.01 | 0.26 | 0.009 | 0.019 | 0.027 | 0.0026 | 9 | | |
| 14 | capped | 0.028 | 0.01 | 0.20 | 0.010 | 0.020 | 0.063 | 0.0023 | −1 | | |
| 15 | rimmed | 0.030 | 0.01 | 0.31 | 0.007 | 0.014 | 0.008 | 0.0027 | 20 | 0.016 | 0.009 |
| 16 | rimmed | 0.050 | 0.01 | 0.33 | 0.006 | 0.014 | 0.008 | 0.0014 | 22 | 0.19 | 0.005 |
| 17 | capped | 0.040 | 0.01 | 0.28 | 0.011 | 0.022 | 0.065 | 0.0026 | 3 | | |
| 18 | capped | 0.040 | 0.01 | 0.27 | 0.014 | 0.025 | 0.065 | 0.0024 | 2 | | |

TABLE VI

Chemical composition and hardness

| sample No. | steel type | [Mn]/S | P | Rockwell 30 T hardness (HR 30T) cycle A after annealing | cycle A tin plate | cycle B after annealing | cycle B tin plate | note |
|---|---|---|---|---|---|---|---|---|
| 1 | rimmed | 24 | 0.008 | 52.4 | 57.6 | 48.1 | 54.6 | |
| 2 | rimmed | 21 | 0.006 | 52.7 | 57.7 | 49.6 | 55.9 | |
| 3 | rimmed | 22 | 0.012 | 53.0 | 58.0 | 50.4 | 55.4 | |
| 4 | rimmed | 34 | 0.008 | 52.9 | 57.9 | 50.0 | 55.3 | Satisfies first |
| 5 | rimmed | 26 | 0.010 | 52.9 | 58.7 | 49.3 | 55.2 | and second embo- |
| 6 | rimmed | 25 | 0.007 | 52.7 | 57.7 | 48.6 | 54.8 | diments |
| 7 | rimmed | 27 | 0.009 | 53.3 | 59.5 | 49.5 | 54.7 | |
| 8 | rimmed | 22 | 0.010 | 52.8 | 58.1 | 48.2 | 54.3 | |
| 9 | capped | 6 | 0.016 | 56.1 | 61.2 | 53.3 | 58.8 | Departs from first |
| 10 | rimmed | 10 | 0.016 | 55.5 | 61.3 | 54.0 | 59.6 | and second embodiments |
| 11 | rimmed | 12 | 0.015 | 55.0 | 60.5 | 50.6 | 56.0 | |
| 12 | capped | 3 | 0.013 | 55.8 | 61.1 | 50.1 | 55.6 | |
| 13 | rimmed | 9 | 0.009 | 53.4 | 60.5 | 51.2 | 56.7 | Satisfies second |
| 14 | capped | −1 | 0.010 | 54.7 | 61.5 | 52.5 | 57.4 | embodiment |
| 15 | rimmed | 20 | 0.007 | 53.3 | 56.6 | 49.6 | 55.8 | vanadium added |
| 16 | rimmed | 22 | 0.006 | 53.8 | 55.2 | 51.2 | 55.8 | chromium added |
| 17 | capped | 3 | 0.011 | 54.2 | 61.0 | 52.5 | 57.6 | coiled at normal temperature (680° C) |
| 18 | capped | 2 | 0.014 | 55.3 | 60.4 | 51.7 | 56.4 | coiled at higher temperature (680° C) |

Sample No. 15 contains vanadium and sample No. 16 contains chromium. The addition of vanadium or chromium is especially effective in cycle A of FIG. 2. They show temper T - 2½ properties even in the cycle A although the value of [Mn]/S by analysis is at the lowest range permitted in the first embodiment.

Sample No. 17 and No. 18 which satisfy the second embodiment show the effect of coiling temperature after hot rolling of strip. Increasing the coiling temperature from 600° C to 680° C results in a tendency towards reduced Rockwell 30T hardness in case of both the cycle A and the cycle B of FIG. 2.

EXAMPLE 2

The compositions of the steel strip used are shown in Table VII. The steel was rolled from an ingot to a slab, hot rolled into hot band of 2.0 mm thickness, pickled and cold rolled to a steel strip 0.32 mm thick, and then continuously annealed in cycles similar to cycle B of FIG. 2 in which 30, 60, 300 and 1800 seconds at 450° C were selected as overaging treatment, temper rolled to 1.5% in elongation, and electrolytically tinned and flow-brightened.

The results of the Rockwell 30T hardness measurement of tin plate are shown in Table VIII. The phosphorus contents of these two samples are less than 0.015% to satisfy the second embodiment but the values of [Mn]/S of these steels are small, and therefore the values of the Rockwell 30T hardness remains at the upper range of temper T - 3.

Concerning the overaging time at 450° C, 60 seconds is considered to be enough because there can be seen little change in the Rockwell 30T hardness after 60 seconds.

TABLE VII

Chemical composition of the steel (%)

| sample No. | steel type | C | Si | Mn | P | S | O | N | [Mn]/S | note |
|---|---|---|---|---|---|---|---|---|---|---|
| 1 | capped | 0.045 | 0.01 | 0.30 | 0.011 | 0.017 | 0.065 | 0.0022 | 5 | coiling temp. 600° C |
| 2 | capped | 0.039 | 0.01 | 0.29 | 0.008 | 0.015 | 0.060 | 0.0020 | 6 | coiling temp. 600° C |

TABLE VIII

Overaging time and hardness ( HR 30T)

| sample No. | Mn/S | P | 30 seconds after annealing | 30 seconds tin plate | 60 seconds after annealing | 60 seconds tin plate | 300 seconds after annealing | 300 seconds tin plate | /800 seconds after annealing | /800 seconds tin plate |
|---|---|---|---|---|---|---|---|---|---|---|
| 1 | 5 | 0.011 | 54.1 | 59.8 | 53.4 | 58.7 | 52.0 | 57.8 | 52.3 | 58.6 |
| 2 | 6 | 0.008 | 53.0 | 58.9 | 52.3 | 57.7 | 52.1 | 58.2 | 51.7 | 57.8 |

EXAMPLE 3

Two capped steel ingots were rolled into slabs, hot rolled into a hot band of 2 mm thickness, the compositions of which are shown in Table IX, pickled and cold rolled to 0.32 mm thickness and continuously annealed by cycle C of FIG. 2, where the time needed to cool from 550° to 250° C is about 44 seconds. The results measured are also shown in Table IX. The results show that it is possible to practice the second embodiment of the present invention and produce tin plate with temper T - 2½ or T - 3 properties by utilizing a conventional continuous annealing line for tin plate and black plate with no overaging chamber, by the proper reduction of its operating speed, even if the carbon content of steel strip is higher than 0.05%.

TABLE IX

The result of continuous annealing test (cycle C of FIG. 2)

| sample No. | steel type | C | Si | Mn | P | S | O | N | [Mn]/S | hardness (HR 30 T) after annealing | hardness (HR 30 T) tin plate |
|---|---|---|---|---|---|---|---|---|---|---|---|
| 1 | capped | 0.07 | 0.01 | 0.33 | 0.013 | 0.017 | 0.030 | 0.0022 | 13 | 52.0 | 56.3 |
| 2 | capped | 0.06 | 0.01 | 0.32 | 0.013 | 0.013 | 0.028 | 0.0024 | 17 | 52.5 | 56.8 |

EXAMPLE 4

Two rimmed steel ingots were rolled into slabs, hot rolled into hot bands of 2.0 mm thickness, of which the compositions are listed in Table X, pickled and cold rolled to 0.32 mm thick, continuously annealed by the cycle B of FIG. 2, temper tolled to 1.5% in elongation, and then electrolytically tinned and flow-brightened.

The Rockwell 30T hardness and other mechanical properties measured as shown in Table XI. The Rockwell 30T hardness of the sample No. 1 showed the center value of T - 2½ range and that of the sample No. 2 showed the center value of T - 3 range.

Other mechanical properties also proved to be equal to the ones of usual box-annealed products, showing low yield strength and ultimate tensile strength together with excellent elongation.

TABLE X

Chemical composition of the steel (%)

| Sample No. | Steel type | C | Si | Mn | P | S | O | N | [Mn]/S |
|---|---|---|---|---|---|---|---|---|---|
| 1 | rimmed | 0.024 | 0.01 | 0.28 | 0.007 | 0.011 | 0.036 | 0.0008 | 14 |
| 2 | rimmed | 0.036 | 0.01 | 0.34 | 0.015 | 0.022 | 0.029 | 0.0010 | 11 |

TABLE XI

Mechanical properties (tin plate produced by a practical annealing line)

| sample No. | hardness (HR 30 T) after annealing | hardness (HR 30 T) tin plate | yield strength Kg/mm² | tensile strength Kg/mm² | elongation (%) | work hardening modulus (n) | Lankford's value(r) | note |
|---|---|---|---|---|---|---|---|---|
| 1 | 48.6 | 54.7 | 28.4 | 35.3 | 36.0 | 0.16 | 1.31 | correspond to the center value of T-2½ |
| 2 | 52.4 | 57.5 | 32.1 | 37.9 | 30.6 | 0.15 | 1.25 | correspond to the center value of T - 3 |

As mentioned above in detail, proper restriction of the amount of carbon, manganese, sulphur, nitrogen and phosphorus in the steel strip together with the value of [Mn]/S make it possible to fabricate continuously annealed soft tinplate with temper T - 3 properties in case of the cycle A of FIG. 2 and with temper T - 2½ or T - 3 properties in case of the cycle B or cycle C of FIG. 2 where the time to cool from 550° to 250° C is longer than 30 seconds.

The addition of a trace of carbide former such as chromium or vanadium, is quite effective in the softening, and in particular, the addition of these carbide formers strengthens the effectiveness of the cycle A of FIG. 2 up to the level of the cycle B of FIG. 2, which contains an overaging step.

Concerning the amount of chromium or vanadium, the desirable upper limits of chromium and vanadium are 0.20% and 0.03% respectively, considering the effect on the deterioration of the workability and the anisotropy in crystal structure of annealed products.

On the other hand, the desirable lower limits of chromium and vanadium added are 0.02% and 0.005% respectively in order to provide a sufficient number of carbide nuclei to serve as targets or sites for the diffusion and precipitation of carbon atoms.

The Rockwell 30T hardness of products are reduced with increasing soaking temperature when continuously annealed in a cycle satisfying the second embodiment of the present invention, and show the lowest value of temper T - 2½ range, i.e. 52 – 53 (HR 30T) at the soaking temperature of 900° C.

Coiling at higher temperature after hot rolling of strip has a slight effect on the softening of continuously annealed products, but the difficulty in descaling in the pickling of the hot strip before cold rolling is a drawback of higher-temperature-coiled products, sometimes resulting deterioration of surface appearance of tin mill products. Therefore coiling at high temperature is not necessarily required.

As has been explained, it is unnecessary to apply any particular treatment in the processes of ingot processing, slab rolling and hot-strip rolling to practice the present invention. Therefore the present invention is a superior industrial method for fabrication of soft tin plate having temper T - 2½ or T - 3 properties with high productivity by simple apparatus.

What is claimed is:

1. A method of producing a soft thin steel sheet in a continuous annealing heat cycle for tin plate and black plate with T-2½ or T-3 tempering properties which consists of:

a. heating a steel strip to a soaking temperature ranging from the recrystallization temperature to 900° C by a continuous annealing furnace, without an overaging zone, used in annealing black plate, b. maintaining said heat soaking temperature for 16 to 48 seconds, c. cooling to about 550° C in 20 to 60 seconds, d. cooling from 550° C to 250° C within 30 seconds and e. cooling to room temperature in 16 to 48 seconds, said steel strip being that produced by rolling a rimmed or capped steel ingot to form a slab, hot-strip rolling, and cold rolling to form a steel strip, the composition of said steel strip consisting essentially of: C $\leqq$ 0.050%, Mn $\leqq$ 0.50%, S $\leqq$ 0.025%, N $\leqq$ 0.0030%, P $\leqq$ 0.012%, {(Mn%) − (55/16) (0%)}/(S%) $\geqq$ 20, Fe and inevitable residual impurities.

2. A method of producing a soft thin steel sheet in a continuous annealing heat cycle for tin plate and black plate with T - 2½ or T - 3 tempering properties which consists of:

a. heating a steel strip to a soaking temperature ranging from recrystallization temperature to 900° C, b. maintaining said heat soaking temperature for 20 to 48 seconds, c. cooling to about 550° C at the cooling rate of less than 20° C/sec, d. cooling from 550° C to 250° C in more than 30 to 91 seconds or maintaining a temperature ranging from 550° to 250° C for more than 30 6 seconds and less than 60 seconds, and then cooling to room temperature, said steel strip being that produced by rolling a rimmed or capped steel ingot to form a slab, hot-strip rolling, and cold rolling to form a steel strip, the composition of said steel consisting essentially of C $\leqq$ 0.10%, Mn $\leqq$ 0.50%, S $\leqq$ 0.025%, P $\leqq$ 0.020%, N $\leqq$ 0.0030%, Fe and inevitable residual impurities, and satisfying at least one condition of the following two conditions;

a. P $\leqq$ 0.015% and b. {(Mn%) - (55/16) (10%)}/(S%) $\geqq$ 12.

3. A method according to claim 1 wherein the steel strip additionally contains 0.02 to 0.20% chromium or 0.005 to 0.03% vanadium by weight.

4. A method according to claim 2 wherein the steel strip additionally contains 0.02 to 0.20% chromium or 0.005 to 0.03% vanadium by weight.

5. The soft thin steel sheet for tin plate and black plate produced by the process of claim 1.

6. The soft thin steel sheet for tin plate and black plate produced by the process of claim 2.

* * * * *